US012193536B1

(12) United States Patent
Lee

(10) Patent No.: US 12,193,536 B1
(45) Date of Patent: Jan. 14, 2025

(54) SECURING STRIP OF A WEARABLE PRODUCT

(71) Applicant: OTTO INTERNATIONAL, INC., Fairburn, GA (US)

(72) Inventor: Razgo Lee, Diamond Bar, CA (US)

(73) Assignee: OTTO INTERNATIONAL, INC.

( * ) Notice: Subject to any disclaimer, the term of this patent is extended or adjusted under 35 U.S.C. 154(b) by 0 days.

(21) Appl. No.: 15/499,066

(22) Filed: Apr. 27, 2017

(51) Int. Cl.

| | |
|---|---|
| ***A42B 1/22*** | (2006.01) |
| ***A42B 1/004*** | (2021.01) |
| ***A42B 1/0182*** | (2021.01) |
| ***A42B 7/00*** | (2006.01) |
| ***A42C 1/08*** | (2006.01) |
| ***A44B 17/00*** | (2006.01) |

(52) U.S. Cl.
CPC ..... *A42B 1/22* (2013.01); *A42B 1/004* (2013.01); *A42B 1/0182* (2021.01); *A42B 7/00* (2013.01); *A42C 1/08* (2013.01); *A44B 17/0029* (2013.01); *A44B 17/0041* (2013.01); *A44B 17/0058* (2013.01)

(58) Field of Classification Search
CPC ..... A42B 1/22; A42B 1/004; A42B 1/062; A42B 7/00; A42B 1/248; A42B 1/24; A42C 1/08; A44B 17/0029; A44B 17/0041
USPC ..... 2/183, 171.4, 171.5
See application file for complete search history.

(56) References Cited

U.S. PATENT DOCUMENTS 2,527,258 A * 10/1950 Kahn ..... A41D 3/00 40/586
2,869,137 A * 1/1959 Scherz ..... A42B 1/22 2/183
3,577,561 A * 5/1971 Oshima ..... A42B 3/061 359/518
4,480,399 A * 11/1984 Teti, Jr. ..... G09F 7/16 40/584
4,481,681 A * 11/1984 Hankin ..... A41D 20/00 2/181
4,621,441 A * 11/1986 Wagner ..... G09F 3/00 36/1
4,697,362 A * 10/1987 Wasserman ..... A43B 3/0078 36/136
4,872,218 A * 10/1989 Holt ..... A42B 1/225 2/171.5
5,003,640 A * 4/1991 Pizzacar ..... A42B 1/248 2/181.4
5,315,714 A * 5/1994 Peters ..... A42B 1/22 2/181.4

(Continued)

FOREIGN PATENT DOCUMENTS

KR 20180063635 A * 12/2018 ..... A42B 1/00

OTHER PUBLICATIONS

English Translation of Description for KR 2018/0063635A provided by www.espacenet.com (Year: 2018).*

*Primary Examiner* — Alissa L Hoey

(74) *Attorney, Agent, or Firm* — Platinum Intellectual Property PC

(57) ABSTRACT

A size adjusting structure has two members forming a secured structure when the two members are engaged with each other. One of the two members can contain an engaging protrusion and the other member can contain an engaging recess on one side and a substantially flat and hole-less surface on the opposite side. The size adjusting structure can be part of a cap, hat, bag, or any other consumer products.

10 Claims, 7 Drawing Sheets

(56) References Cited

U.S. PATENT DOCUMENTS 5,452,479 A * 9/1995 Mostert ..... A42B 1/248 2/195.1
5,499,402 A * 3/1996 Rose ..... A42B 1/248 2/181.4
5,519,892 A * 5/1996 Pizzacar ..... A42B 1/248 2/181
5,533,213 A * 7/1996 Reiner ..... A42B 1/248 2/195.2
5,546,605 A * 8/1996 Mallardi ..... A42B 1/22 2/181
5,632,047 A * 5/1997 Van Den Heuvel ... A42B 1/248 2/171.4
5,657,491 A * 8/1997 Young ..... A42B 1/061 2/195.2
5,894,603 A * 4/1999 Capozzi ..... A42B 1/22 2/171.02
6,237,155 B1 * 5/2001 Seegar ..... A42B 1/22 2/209.12
D455,539 S * 4/2002 Kates ..... D2/882
6,519,779 B1 * 2/2003 Taguchi ..... A42B 1/248 2/195.1
D478,710 S * 8/2003 Yan ..... D2/882
7,052,154 B2 * 5/2006 Vanderschuit ..... A42B 1/244 362/105
7,219,374 B2 * 5/2007 Cho ..... A61F 9/045 2/181
7,421,980 B1 * 9/2008 Ehlers ..... A01K 27/006 119/858
7,461,764 B2 * 12/2008 Thompson ..... A42B 1/002 2/209.13
8,452,039 B2 * 5/2013 Wright ..... H04R 1/1058 381/381
8,793,846 B2 * 8/2014 d'Auriac ..... A41D 27/08 24/303
8,869,312 B2 * 10/2014 Tuohy ..... A42B 1/004 2/209.13
9,265,310 B2 * 2/2016 Lam ..... H04M 1/0254
D757,402 S * 5/2016 White ..... D2/891
9,955,744 B1 * 5/2018 Yanes ..... A42B 1/248
10,165,816 B2 * 1/2019 Cho ..... A42B 1/248
10,238,161 B1 * 3/2019 Ong ..... A42B 1/22
10,238,185 B1 * 3/2019 Ong ..... A44B 17/0058
D874,794 S * 2/2020 Patel ..... D2/891
11,291,259 B1 * 4/2022 Dugosh ..... A42B 1/248
11,463,794 B1 * 10/2022 Guo ..... H04R 1/1025
2003/0131396 A1 * 7/2003 Park ..... A42B 1/22 2/183
2004/0226078 A1 * 11/2004 Lahman ..... A42B 1/08 2/413
2005/0152142 A1 * 7/2005 Traynor ..... E01F 9/524 362/108
2008/0141567 A1 * 6/2008 Chen ..... A42B 1/248 40/1.5
2009/0188442 A1 * 7/2009 Dawe ..... A01K 27/006 119/792
2011/0079045 A1 * 4/2011 Bielkiewicz ..... G09F 3/005 63/1.13
2011/0219522 A1 * 9/2011 Petitt ..... A42B 1/245 2/209.13
2013/0042391 A1 * 2/2013 Hill ..... A45C 13/08 2/244
2013/0074545 A1 * 3/2013 Moloney ..... A43B 23/24 63/3.1
2013/0174327 A1 * 7/2013 Baum ..... A43B 1/0027 2/245
2013/0205473 A1 * 8/2013 Kronenberger ..... A42B 1/248 2/209.13
2013/0333095 A1 * 12/2013 Dudick ..... A42B 1/205 2/209.12
2014/0053319 A1 * 2/2014 Cho ..... A42B 1/248 2/209.13
2014/0101820 A1 * 4/2014 Cho ..... A42B 1/22 2/171
2014/0245521 A1 * 9/2014 Johns ..... A42B 1/004 2/209.13
2015/0359304 A1 * 12/2015 Thomas ..... A44C 17/0208 63/1.11
2016/0021961 A1 * 1/2016 Lacy ..... A42B 1/22 2/195.4
2016/0353846 A1 * 12/2016 Zanghi ..... A44C 5/0053
2017/0079362 A1 * 3/2017 Olcese ..... A42B 1/22
2017/0143060 A1 * 5/2017 Kronenberger ..... A42B 1/248
2017/0251741 A1 * 9/2017 Wang ..... H04R 5/0335
2017/0325532 A1 * 11/2017 Gerpheide ..... F21S 9/037
2018/0084856 A1 * 3/2018 Lee ..... A42B 1/248
2018/0110278 A1 * 4/2018 Chalmers ..... A42B 1/248
2018/0153241 A1 * 6/2018 Cho ..... A42B 1/24
2019/0350291 A1 * 11/2019 Maldonado ..... F21V 21/084
2021/0227915 A1 * 7/2021 Leatherman ..... A42B 1/22
2022/0295931 A1 * 9/2022 Eldridge ..... G09F 3/16
2022/0408883 A1 * 12/2022 Cungu ..... A42B 1/22

* cited by examiner

SECURING STRIP OF A WEARABLE PRODUCT

FIELD OF INVENTION

The present invention relates to wearable consumer products. Specifically, the present invention relates to caps, hats, and bags with a securing snapback strip.

BACKGROUND OF THE INVENTION

Typically, a consumer wearable, such as a baseball cap, contains various structures for size adjustments. It is known that a securing strip with one or more through holes going through the entire thickness of a female end of the securing strip. The through holes forms the void part of the strip, which reduces the aesthetic value of the strip and the entire cap.

SUMMARY OF THE INVENTION

In an aspect, a cap comprises a body of a cap, a size adjusting strap/member having a first elongate member and a second elongated member, a male protrusion on the first elongated member, and one or more recesses at an inner surface on the second elongated member, wherein the male protrusion is structured to engage and secure the one or more recesses. In some embodiments, the recesses comprises a bottom surface opposite to the surface containing the recesses.

In some embodiments, the second elongated member comprises a cavity on an outer surface. In some other embodiments, the cavity is coupled with an insertable piece. In some embodiments, the cavity is filled with a solidifyable chemical. In other embodiments, the solidifyable chemical comprises a polymeric material. In some other embodiments, the polymeric material comprises silicone. In some embodiments, the polymeric material comprises resin. In other embodiments, the first elongated member, the second elongated member, or both are made of one or more plastic material, polymer, or both. In some other embodiments, the first elongated member, the second elongated member, or both are made of one or more plastic material, polymer, or both. In some embodiments, the first elongated member, the second elongated member, or both are made of fabrics. In other embodiments, the recesses are not through holes.

In another aspect, a method of making a cap comprises forming a body of a hat and forming a size adjusting member coupled with the body, wherein the size adjusting member comprises a first member instantly separable from a second member, wherein the first member has a securing protrusion structure and the second member has a cavity on a side facing inward configured to form an engaged/coupled size adjusting member by engaging the securing protrusion structure.

In some embodiments, the second member comprises a flat surface throughout a substantial all of a surface facing outward, wherein the flat surface includes the bottom of the cavity. In other embodiments, the second member comprises a recess surface facing outward. In some other embodiments, the recess surface is configured to couple with an insertable decorative piece. In some embodiments, the recess surface is filled with a solidifyable material. In some other embodiments, the solidifyable material comprises a monomer of a polymer. In some embodiments, the polymer comprises a plastic.

In another aspect, a securing structure comprises a male protrusion on a first elongated member and one or more recesses at a first surface on a second elongated member, wherein the male protrusion is structured to engage and secure the one or more recesses, wherein the first surface is facing opposite to a second surface, wherein the second surface has a flat surface across substantial all of the second surface.

In some embodiments, the second surface comprises a recess. In other embodiments, the recess is filled with a decorative piece forming an entirely smooth, uninterrupted, and/or continuous surface. In some other embodiments, the recess is filled with a polymer.

DETAILED DESCRIPTION OF THE INVENTION

Figure 1:
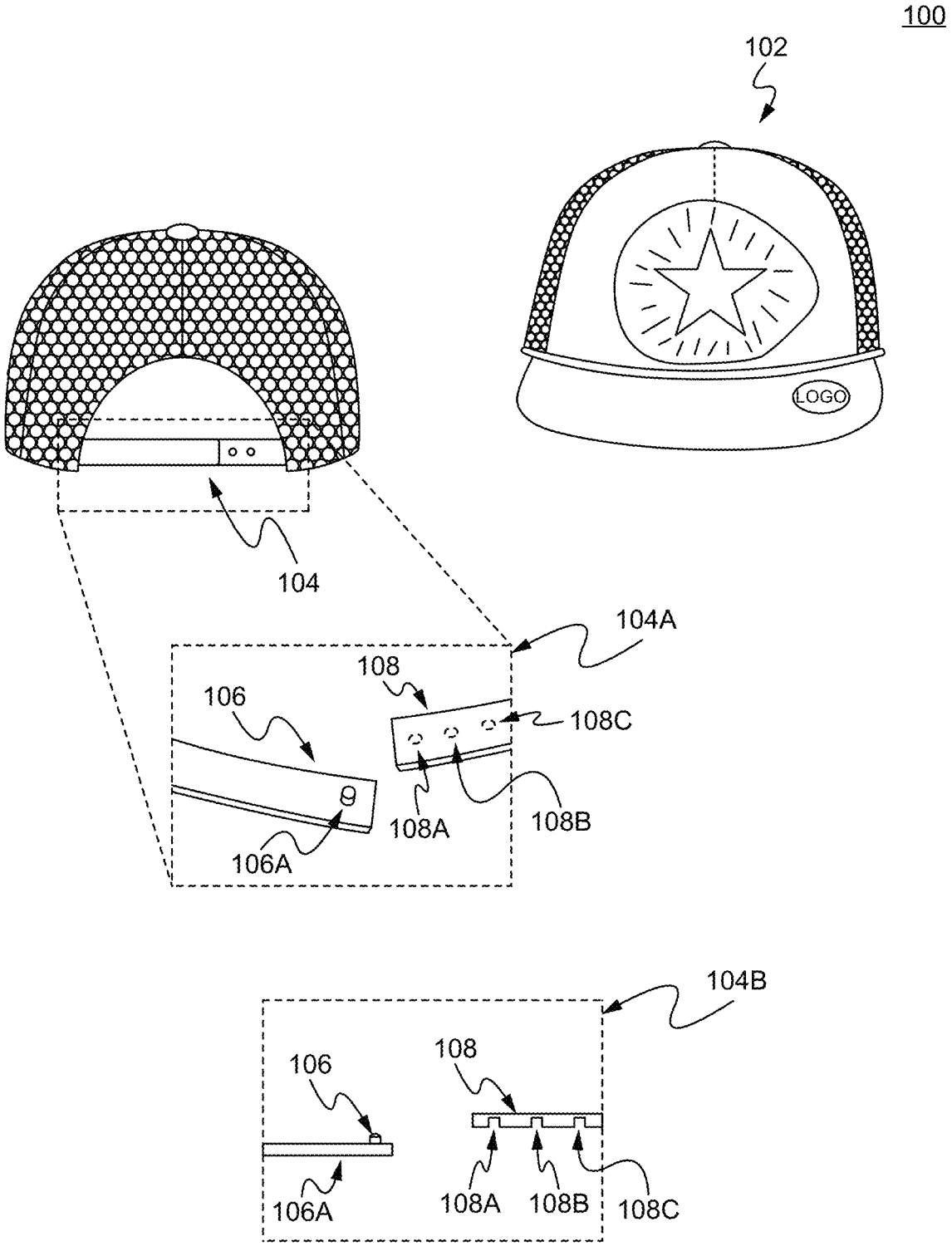
FIG. 1 illustrates a cap with an invisible securing structure in accordance with some embodiments.

FIG. 1 illustrates a cap 100 with an invisible securing structure in accordance with some embodiments. The cap 100 comprises a body 102. The body 102 comprises a securing structure 104. In some embodiments, the securing structure 104 comprises a male end 106 and a female end 108. As shown in a perspective view 104A, the male end 106 comprises one or more bolts 106A configured to be coupled with the cavity 108A, 108B, or 108C on the female end 108 forming a securing structure. The securing structure can be used for adjusting the size of the cap.

In some embodiments, the cavity 108A, 108B, and 108C are recesses from the coupling side and not a through hole. For example, the recesses are half way through the thickness of the female end 108. The recesses are able to be on the side facing toward the body of the cap. In another example, the recesses is almost going through the entire thickness of the female end 108 except having a thin layer, such as 0.01 mm, covering the back. A person of ordinary skill in the art would appreciate that any depth of the recesses are within the scope of the present invention.

The view 104B shows a top view of the securing structure 104. The bolt 106 can couple with one of the recesses 108A, 108B, or 108C to immobilize the size/structure of the cap. The bolt 106A can be snug-fit (e.g., engagement via size fitting and/or friction) into the one of the recesses 108A, 108B, or 108C.

In some embodiments, the securing structure 104 comprises a snapback strip. The securing structure 104 can be made of plastic (e.g., polyethylene (PE)), wool, wood, cotton, or any other materials. The securing structure 104 can be applied to a cap, a hat, a bag, beanies, or any other personal items.

Figure 2:
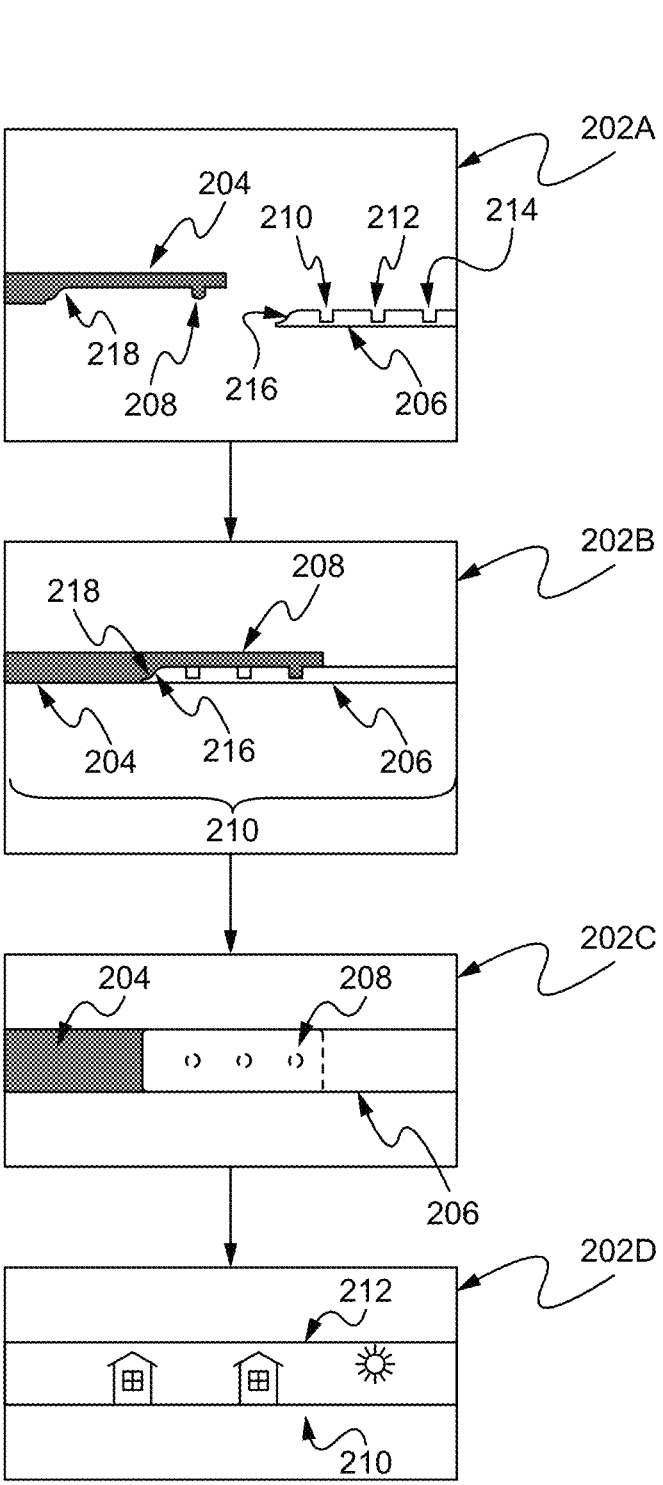
FIG. 2 illustrates a size adjusting member of a baseball cap in accordance with some embodiments.

FIG. 2 illustrates a size adjusting member 200 of a baseball cap in accordance with some embodiments. As shown in view 202A, the size adjusting member 200 comprises a first strip 204 and a second strip 206. The first strip 204 can comprise a protrusion 208 configured to be coupled with one of the recesses 210, 212, or 214 of the second strip 206.

As shown in a top view 202B, the coupling of the first strip 204 and the second strip 206 forms a continuous, integrated, and smooth surface 210. In some embodiments, the first strip 204 comprises an offset slope structure 218, which forms a seamless connection when coupled with the slope 216 of the second strip 206.

As shown in a front view 202C, there is no through hole on the second strip 206, thus the protrusion 208 is invisible from the front view. The doted circle of the protrusion 208 represent a recess engaged the protraction 208 at the back side of the surface and cannot be seen from the front that is facing away from the body of the cap.

As shown in a front view 202D, the entire surface 210 can be a solid surface without holes or interruptions. Decorations 212, such as printing and drawings, can be applied on the surface 210. In some embodiments, the decoration 212 is pre-printed before the assembling of the pieces of the components of the cap. In some embodiments, the decoration 212 is printed after the assembling of the pieces of the components of the cap.

Figure 3:
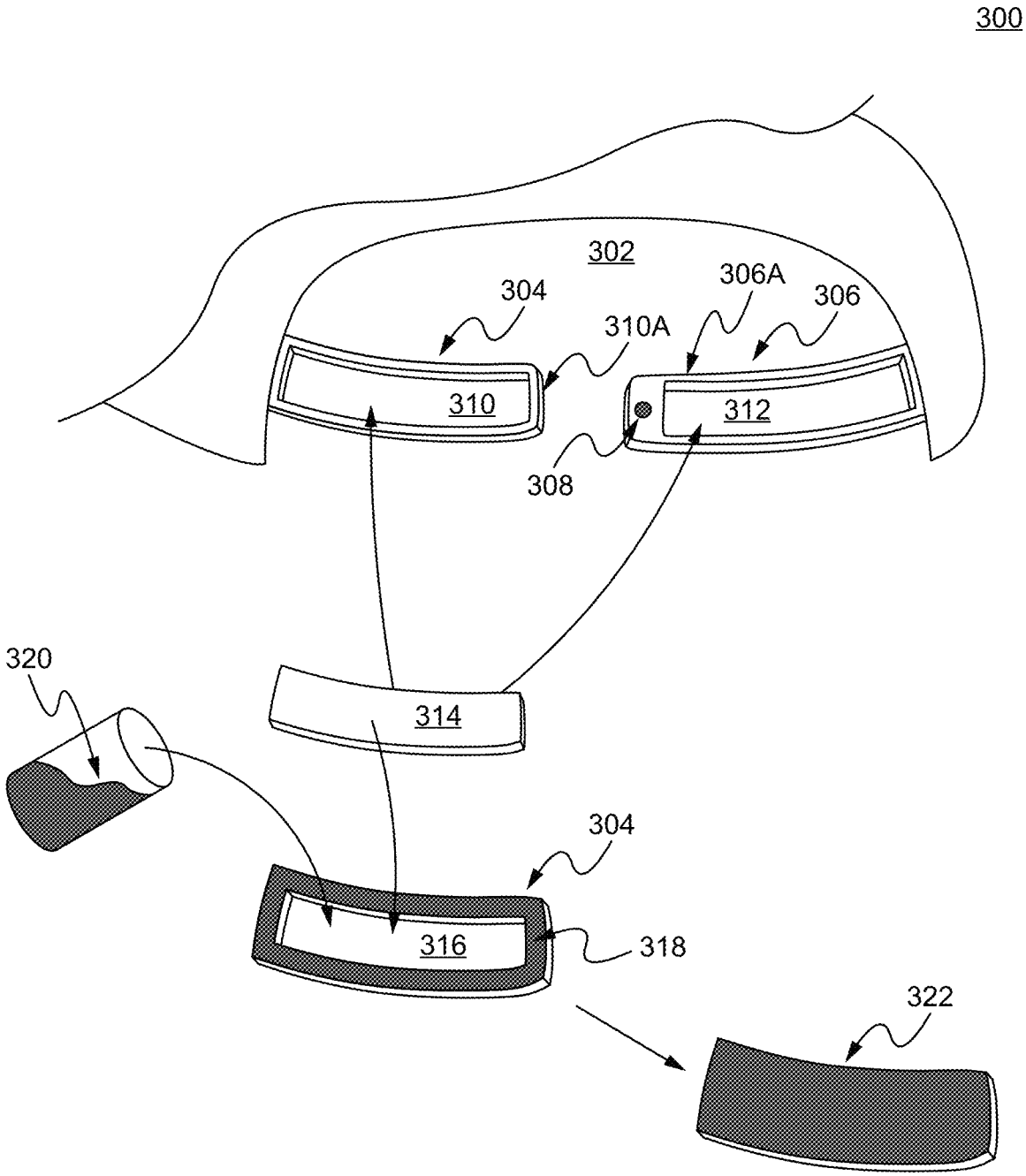
FIG. 3 illustrates a cap in accordance with some embodiments.

FIG. 3 illustrates a cap 300 in accordance with some embodiments. The cap 300 can comprise a securing part 302. The securing part 302 can comprises a left member 304 and a right member 306. The left member 304 and/or the right member 306 can comprise one or more recesses 310 and 312 respectively. In some embodiments, one or more separable decorative pieces 314 can be installed/inserted into the recess of 310 and 312 forming a smooth surface with the protruded frame 310A and 306A, such that a user's finger does not feel the seam between the frame 310A and 306A with the decorative piece 314. The decorative piece 314 can be fixed by glue or any other securing materials. The securing member 308 is able to be used to form a connection by fitting into the recess hole at the back of the left member 304.

In some embodiments, the decorative pieces 314 can be made of plastic, wood, or any other materials. In some embodiments, a frame 318 enclose a recess 316. The frame 318 can be either the frame 310A, 306A, or both. One of more liquid polymers 320 can be filled into the recess 316 forming a smooth and/or flat decorative surface 322. The liquid polymer can be resin, polyethylene, polypropylene, and any other polymeric materials. A hardener, heat, and light (e.g., UV) can be applied to cure the polymer. In some embodiments, nanoparticles of various functions are able to be added to the liquid. For example, nanoparticles (e.g., $Al_2O_3$) for enhancing the hardness of the polymer can be added. In some embodiments, the decorative piece 314 is applied on a size adjustment band with through holes.

Figure 4:
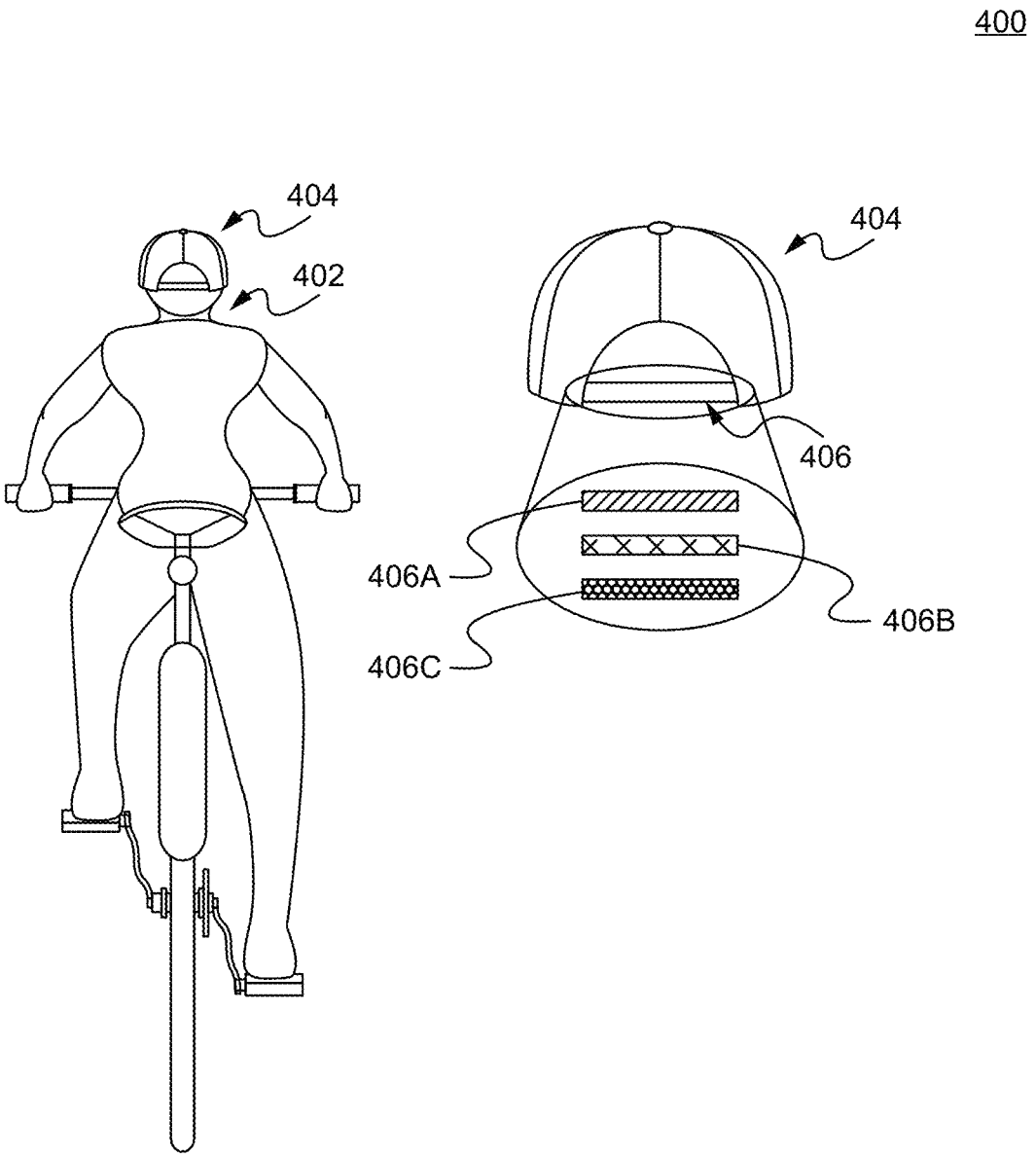
FIG. 4 illustrates a use of a cap in accordance with some embodiments.

FIG. 4 illustrates a use of a cap 400 in accordance with some embodiments. In some embodiments, the bike rider 402 wears the cap 404. A securing member 406 of the cap 404 comprises one of replaceable pieces 406A, 406B, and 406C. Each of the pieces 406A, 406B, and 406C can be of different functions. For example, the piece 406A comprises a light reflective surface, which provides a safety feature for the rider 402. Such that the rider 402 can be seen at night when a car's headlight is reflected by the reflective surface. In another example, the pieces 406B can comprise a light emitting diode (e.g., LED) for emitting lights. In another example, the pieces 406C can comprise wireless earbuds or storing spaces for earbuds or any other consumer electronics.

Figure 5:
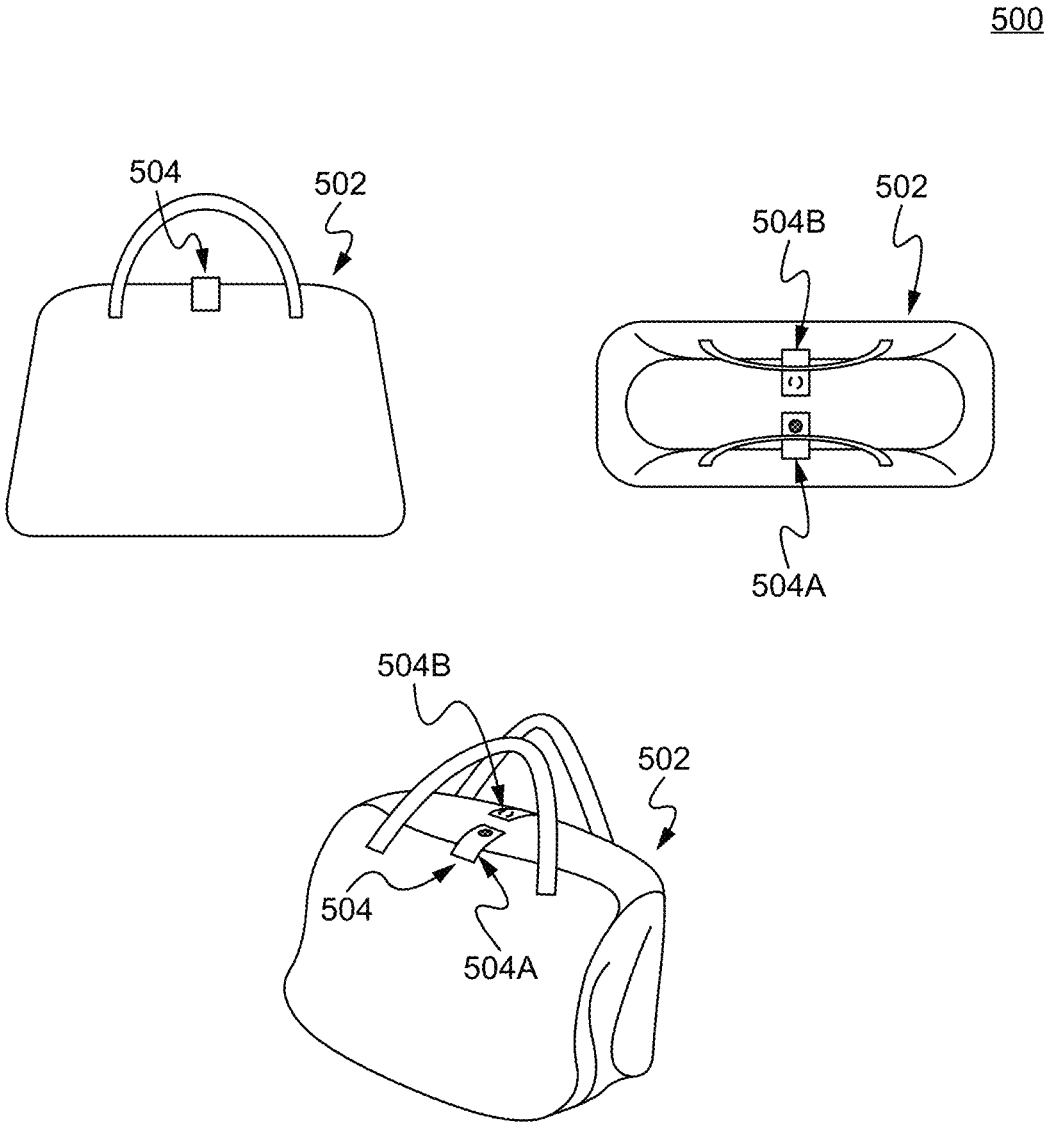
FIG. 5 illustrates a locking mechanism in accordance with some embodiments.

FIG. 5 illustrates a locking mechanism 500 in accordance with some embodiments. In some embodiments, the locking mechanism 500 is applied on a cap, a hat, a bag, or any other wearable substance or personal items. For example, a tote bag 502 can contain the locking mechanism 500 across two sides of the leather tote bag 502. In some embodiments the locking mechanism 500 is applied on a traveling luggage.

In some embodiments, the locking mechanism 500 comprises a securing structure 504. The securing structure 504 comprises a male end 504A and a female end 504B. The male end 504A comprises a locking bolt facing outside of the bag 502. The female end 504B comprises one or more cavities facing toward the opening of the bag 502. The locking bolt is able to be snug-fit or stay in a locked position in the cavities forming a locking mechanism. In some embodiments, the bolt and cavity are swapped with their locations.

Figure 6:
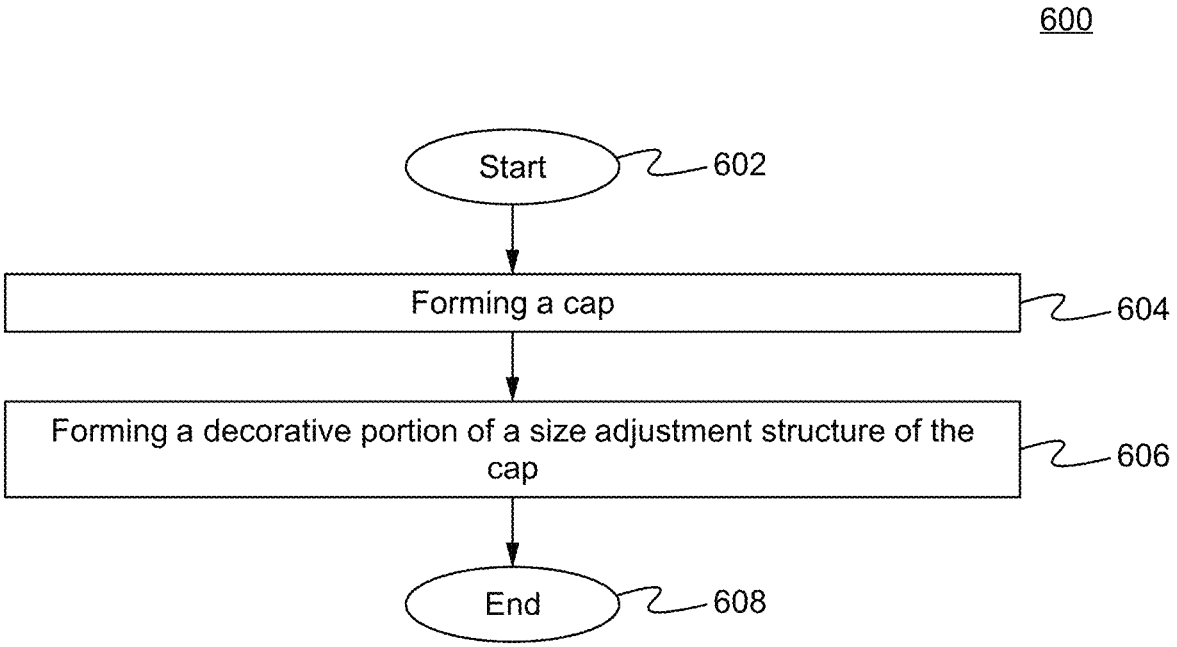
FIG. 6 illustrates a method of making a cap in accordance with some embodiments.

FIG. 6 illustrates a method 600 of making a cap in accordance with some embodiments. The method 600 can start at a Step 602. At a Step 604, a cap is formed. The cap can be made with typical cap manufacturing procedures and materials with the addition of the flat decoratable surface as described above.

At a Step 606, a decorative portion of a size adjustment structure (e.g., a snapback size adjustment band) is formed. In some embodiments, printing, drawings, dyeing, or any coloring processes are used to form the decorative portion of the cap. In other embodiments, an insertable piece is coupled with a recess on the decorative surface forming a smooth surface without holes facing outward. In some other embodiments, a solidifyable liquid (e.g., nature resin and polymer precursors) is filled in the recesses forming a filled surface, such as copal or mastic. The method 600 can stop at a Step 608.

Figure 7:
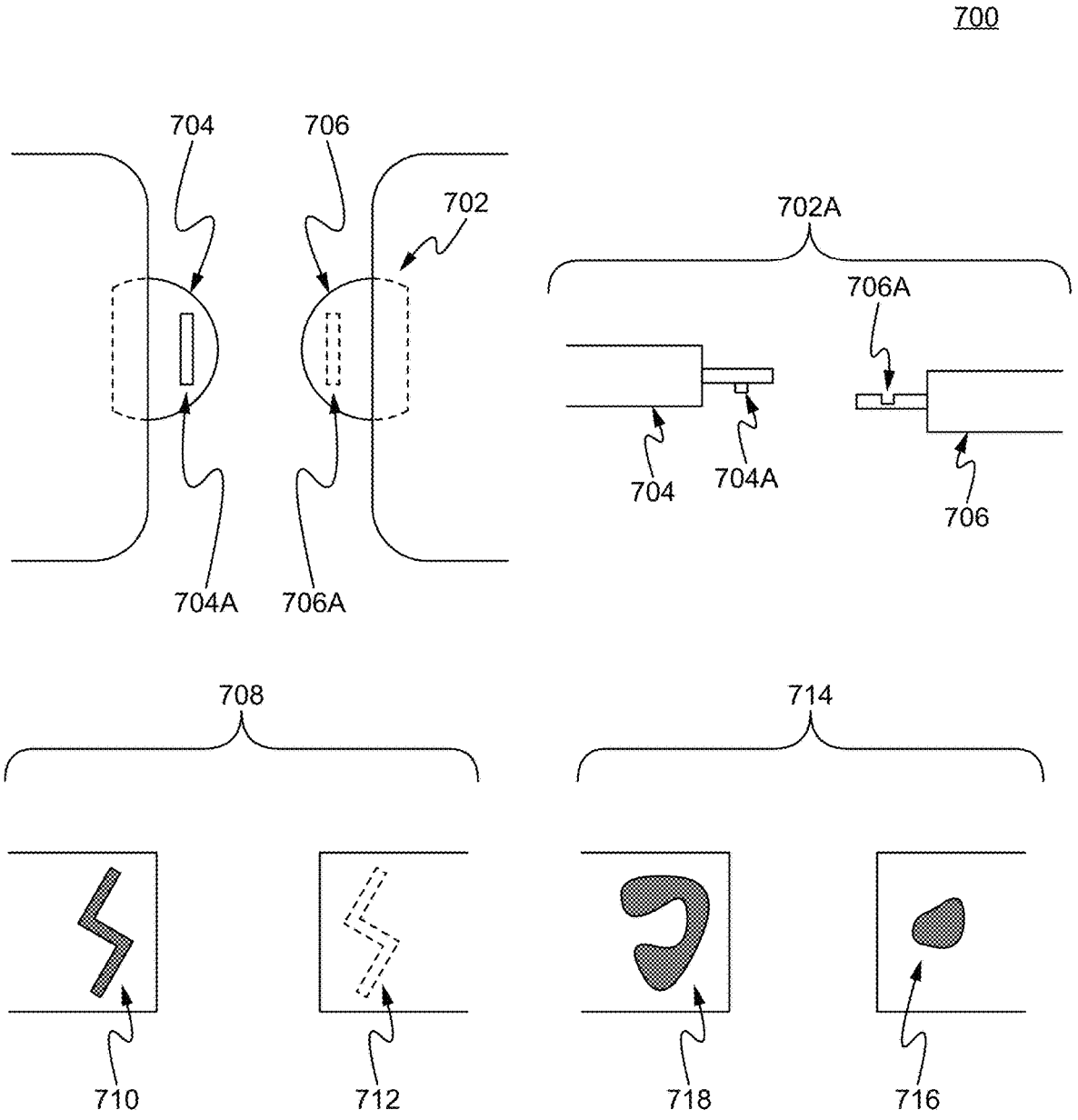
FIG. 7 illustrates various forms of securing structure 700 in accordance with some embodiments.

FIG. 7 illustrates various forms of securing structure 700 in accordance with some embodiments. In some embodiments, the securing structure 700 comprises a round hosting structure 702. Structure 702A is a side view of the hosting structure 702.

An engaging member 704A on a first side 704 is structured to form a secured engagement with a matching member 706A on a second side 706. In some embodiments, the engagement members/matching members 704A and 706A are structured to contain protrusion and recess for engaging each other. A person of ordinary skill in the art appreciates that the engagement host and the engagement member are able to be structured in any pattern and structures, so long as the engagement member are able to be engaging each other and/or hide away. For example, an engagement host 708 contains a lighting shape engagement protruding member 710 and engagement recess member 712. In another example, an engagement host 714 contains a first engagement protruding member 718 and a second engagement protruding member 716. The first engagement protruding member 718 secures/immobilize the second engagement protruding member 716 by shape matching, friction, structural locking, and any other engaging mechanisms.

In utilization, the flat surface of the snapback of the cap can be used to provide a smooth and a perfect (e.g., no holes surface) decorative surface.

In operation, a cap is formed, a decorative surface is formed, and the decorative surface is applied on the size adjustment structure of the cap.

The description is presented to enable one of ordinary skill in the art to make and use the invention. Various modifications to the described embodiments are readily apparent to those persons skilled in the art and the generic principles herein can be applied to other embodiments. Thus, the present invention is not intended to be limited to the embodiments shown but is to be accorded the widest scope consistent with the principles and features described herein. It is readily apparent to one skilled in the art that other modifications can be made to the embodiments without departing from the spirit and scope of the invention as defined by the appended claims.

What is claimed is:

1. A cap comprising:

a) a body of a cap;

b) a size adjusting strap having a first elongated member and a second elongated member;

c) a male protrusion on the first elongated member;

d) two insertable decorative pieces; and e) one or more first recesses at an inner surface on the second elongated member, wherein the male protrusion is structured to engage and secure the one or more first recesses, wherein each of the first elongated member and the second elongated member comprises a respective frame and a respective second recess enclosed by the respective frame, wherein each of the two insertable decorative pieces is insertable into the respective second recess of the first elongated member and the second elongated member and enclosed by the respective frame of the first elongated member and the second elongated member, wherein the male protrusion and the one or more first recesses are on the respective frame of the first elongated member and the second elongated member.

2. The cap of claim 1, wherein a material of the two insertable decorative pieces and that of the first elongated member, the second elongated member, or both comprises polymeric material.

3. The cap of claim 1, wherein the two insertable decorative pieces are formed by a solidifyable chemical.

4. The cap of claim 3, wherein the solidifyable chemical comprises a polymeric material.

5. The cap of claim 4, wherein the polymeric material comprises silicone.

6. The cap of claim 4, wherein the polymeric material comprises resin.

7. The cap of claim 1, wherein the first elongated member, the second elongated member, or both are made of one or more plastic material, polymer, or both.

8. The cap of claim 1, wherein the first elongated member and the second elongated member are made with a same material.

9. The cap of claim 1, wherein the two insertable decorative pieces comprise a light reflective surface.

10. The cap of claim 1, wherein a shape of each of the two insertable decorative pieces matches that of the respective second recess of the first elongated member and the second elongated member.

* * * * *